US005113540A

United States Patent [19]

Sereboff

[11] Patent Number: 5,113,540

[45] Date of Patent: May 19, 1992

[54] FLUID CUSHION WITH PASSAGES FOR ISCHIAL SPINES

[76] Inventor: Joel L. Sereboff, 2215 Millridge Rd., Owings Mills, Md. 21117

[21] Appl. No.: 725,512

[22] Filed: Jul. 3, 1991

[51] Int. Cl.[5] ..... A47C 27/08

[52] U.S. Cl. ..... 5/449; 5/450; 5/451; 5/458; 297/459; 297/DIG. 3

[58] Field of Search ..... 5/450, 451, 449, 441, 5/458, 455, 457, 452, 453; 297/DIG. 3, 459

[56] References Cited

U.S. PATENT DOCUMENTS

| | | | |
|---|---|---|---|
| 180,528 | 8/1976 | Baggett | 5/458 |
| 187,397 | 2/1977 | Macintosh et al. | 5/458 |
| 1,673,636 | 6/1928 | Perry | 297/DIG. 3 |
| 1,830,570 | 11/1931 | Smith et al. | 5/449 |
| 2,625,209 | 1/1953 | Harrison et al. | 297/DIG. 3 |
| 4,766,629 | 8/1988 | Schueler | 5/451 |

FOREIGN PATENT DOCUMENTS

| | | | |
|---|---|---|---|
| 19985 | of 1897 | United Kingdom | 5/458 |

*Primary Examiner*—Alexander Grosz

*Attorney, Agent, or Firm*—Morton J. Rosenberg; David I. Klein

[57] ABSTRACT

This invention provides for a fluid cushion (10) defined by a fluid tight closed housing (22) which is deformable by applied load of a user (12). The fluid cushion (10) includes an upper surface member (24) and a lower surface member (26) having a tubular mechanism (42) defining through passages (46) which are for insertion of particular bones of the human body. The tubular mechanism (42) has tubular sidewall members (50) which are contoured to provide an apex (52) at a substantially central location between the upper surface member (24) and the lower surface member (26) and allows for maintenance of a fluid medium (20) in the space (48) between a pair of openings (32 and 34). In this manner, a resilient and deformable fluid cushion (10) is provided for a user (12) to relieve particular discomforting applied loads to the ischia spine bones of a user (12).

17 Claims, 3 Drawing Sheets

FLUID CUSHION WITH PASSAGES FOR ISCHIAL SPINES

BACKGROUND OF THE INVENTION

1. Field of the Invention

This invention pertains to a deformable fluid cushion to alleviate discomfort in a user due to excessive force loading on a user's ischial spines. In particular, this invention relates to a deformable fluid cushion which allows a user to sit on a base surface for prolonged periods of time with a minimization of discomfort and a minimized possibility of forming decubitus ulcers. More in particular, this invention directs itself to a fluid tight deformable fluid cushion defined by a closed housing having an upper surface member and a lower surface member joined each to the other for the purpose of containing a fluid medium therein. Still further, this invention directs itself to a deformable fluid cushion having a pair of through passages aligned in the neighborhood of the ischial spines of a user. Still further, this invention directs itself to a deformable fluid cushion where a tubular mechanism having sidewalls defines the through passages aligned with the ischial spines of a user. Further, this invention relates to a tubular mechanism having the sidewalls of varying cross-sectional diameters as a function of the vertical distance between the upper and lower surface members forming the fluid tight closed housing. More in particular, this invention directs itself to a tubular mechanism defining the through passages aligned with the ischial spines of the user wherein the through passage has an apex diameter substantially at the midpoint between an undeformed distance between the upper and lower surface members of the fluid tight closed housing. Additionally, this invention directs itself to a deformable and resilient fluid cushion containing a fluid medium wherein there is provided a wave damping mechanism within the internal chamber defined by the closed housing members.

2. Prior Art

Deformable fluid cushions are known in the art. However, fluid cushions having particularly contoured and sized openings for interface with the ischial spines of a person for relief of discomfort in those particular user areas is not known to Applicant. Additionally, particular through passage contouring for a deformable fluid cushion to maintain a fluid medium in a space between the through passage openings is not known to Applicant.

SUMMARY OF THE INVENTION

A fluid cushion is provided including a fluid tight closed housing having an upper surface member and a lower surface member. Each of the upper and lower surface members have a pair of openings formed therethrough with the pair of openings formed through the upper surface member being substantially vertically aligned with the pair of openings formed through the lower surface member. A tubular mechanism is provided for joining the upper and lower surface member openings in fluid tight relation and defines a pair of vertically directed through passages having tubular sidewall members of varying cross-sectional diameters when taken with respect to a vertical direction. The housing and the fluid tubular mechanism define an internal chamber which contains a fluid medium maintained within the overall fluid tight closed housing.

DESCRIPTION OF THE PREFERRED EMBODIMENTS

Figure 1:
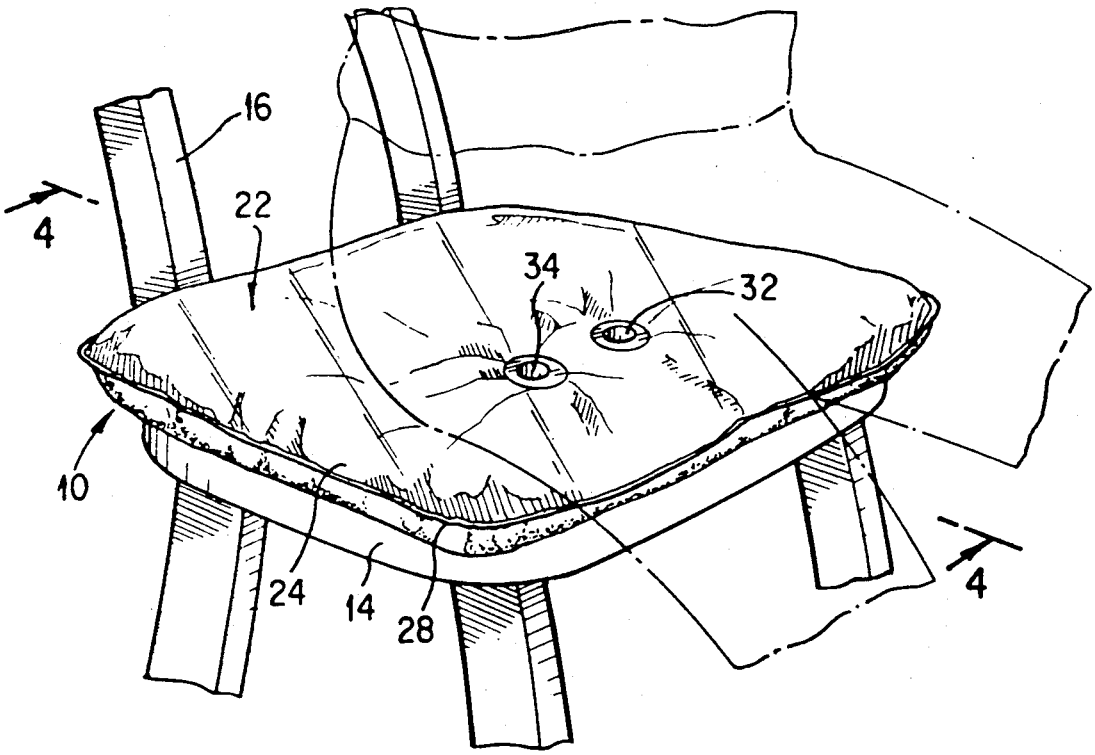
FIG. 1 is a perspective view of the fluid cushion of the invention concept placed on a base surface.
Figure 2:
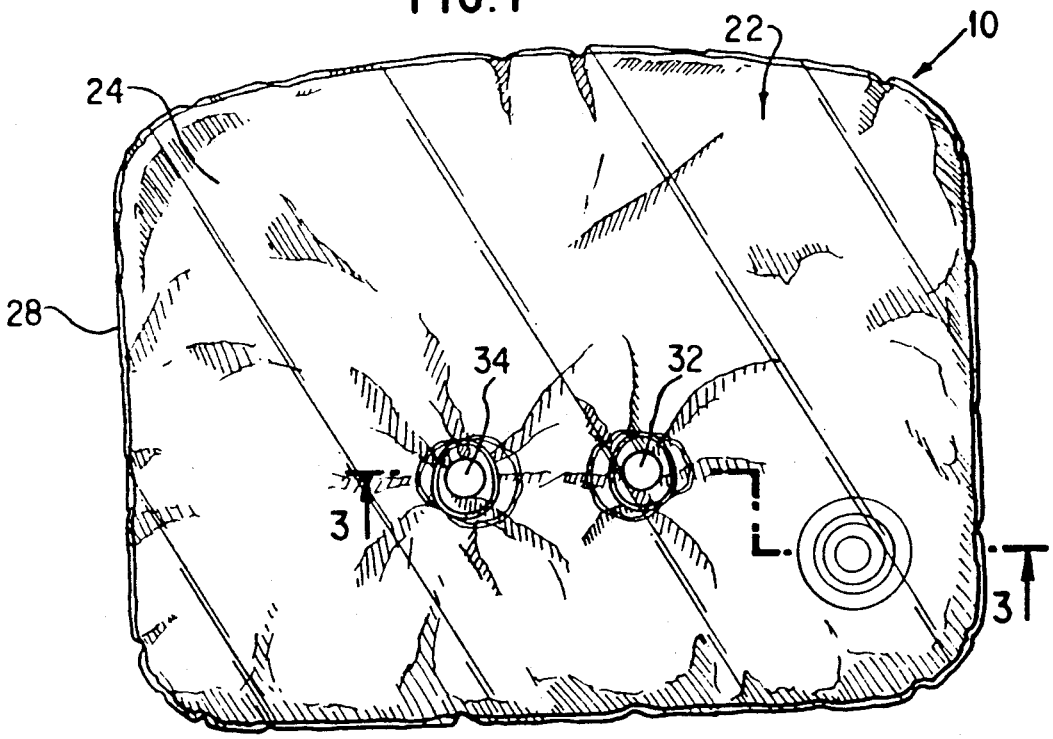
FIG. 2 is a plan view of the fluid cushion of the subject invention concept.
Figure 3:
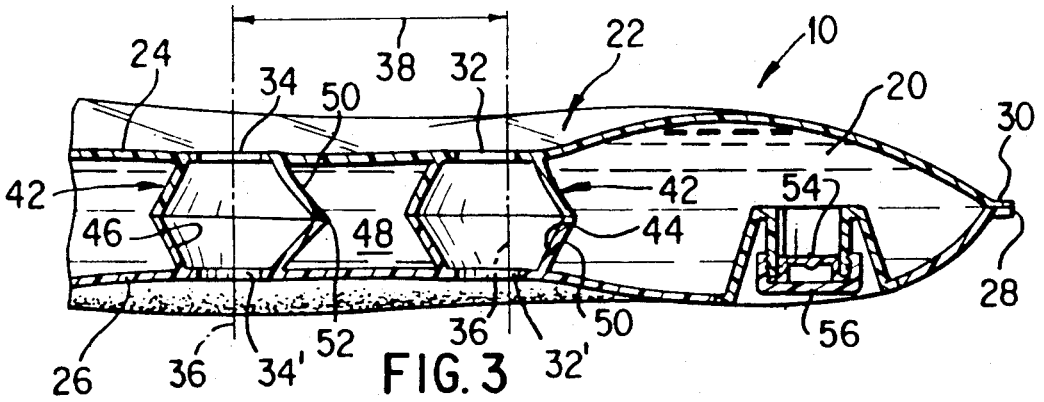
FIG. 3 is a cross-sectional view of the fluid cushion taken along the Section Line 3—3 of FIG. 2.
Figure 4:
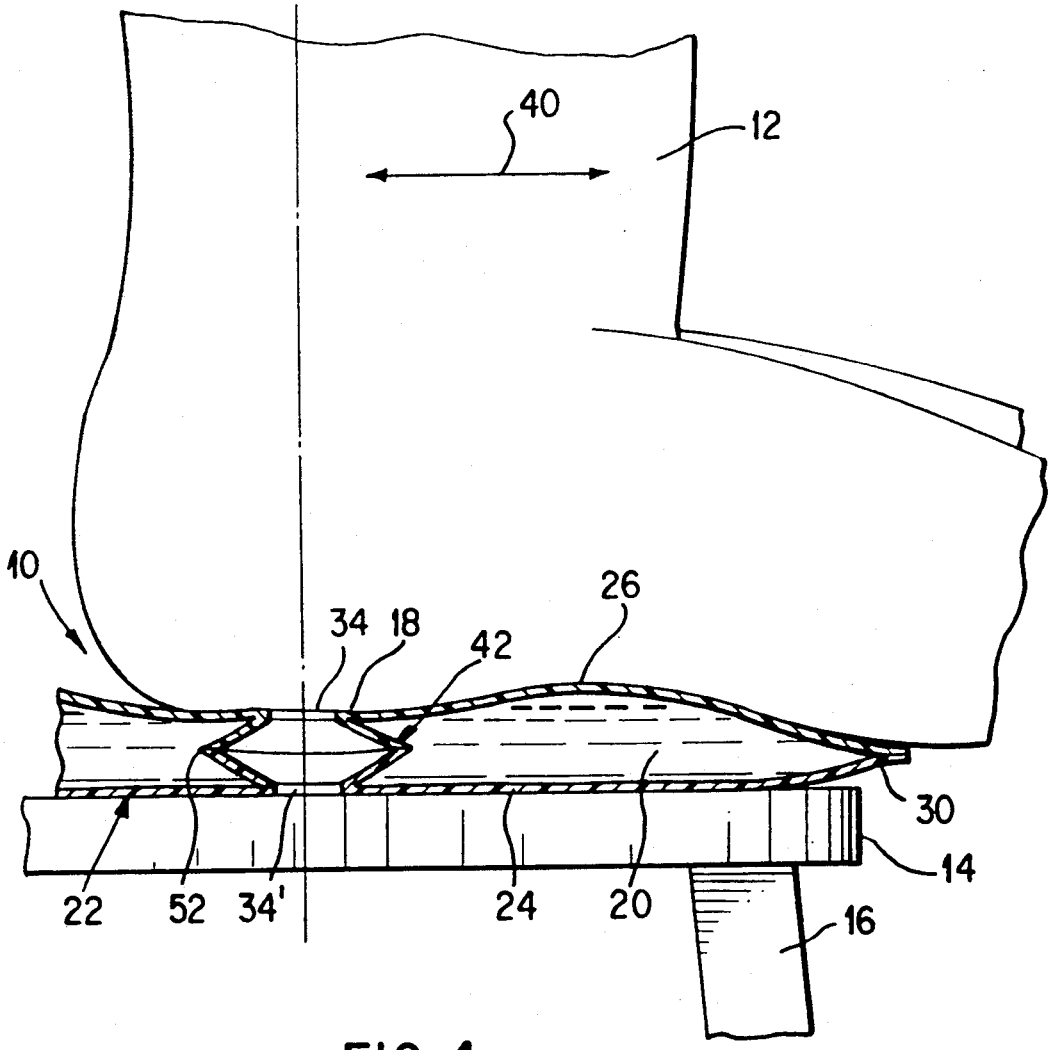
FIG. 4 is a sectional view of the fluid cushion partially cut-away taken along the Section Line 4-4 of FIG. 1; and, FIG. 5 is a partially cut-away view of an embodiment of the subject fluid cushion including a wave damping mechanism contained within the overall fluid tight housing.

Referring now to FIGS. 1-4, there is shown fluid cushion 10 for relieving pressure on the body tissue (muscles, nerves and skin) in the area of the ischium of person 12 sitting thereon as is depicted in FIG. 4, and in phantom line drawing in FIG. 1. The specific contouring of fluid cushion 10 is of extreme importance for distribution of forces applied to body 12 for distribution of forces over a wider surface area at the points of contact 18 in order to relieve discomfort of user or person 12 during a prolonged sitting time interval.

The ischium of person 12 is one of three parts of the hip bone which joins the ilium and the pubis to form the acetabulum. In overall anatomical terms, the ischium comprises the dorsal portion of the hip bone and is divided into the body of the ischium which forms two-fifths of the acetabulum and the ramus which joins the inferior ramus of the pubis. The spine of the ischium provides attachment for a multiplicity of muscles such as the gemellus superior, the coccygeus, and the levitator ani. The greater sciatic notch above the spine transmits the superior and inferior gluteal vessels and various nerves such as the gluteal nerves, the sciatic nerve, and the nerves to the obturator internus and the quadratus femoris. A notch below the spine of the ischium transmits various ligaments, vessels, and nerves. The large dorsal tuberosity of the ischium provides attachment for various muscles such as the adductor longus, the semimembranous, the biceps femoris, and the semi-tendinosus. The ischial spines are two relatively sharp bony projections into the pelvic outlet from the ischial bones that form the lower border of the pelvis.

In general, person 12 does not have a great amount of tissue between the ischial spines and the epidermis of the skin. When pressure builds from the outside such is applied to those bones. Often times, the skin of person 12 breaks down after a prolonged pressure application and causes decubitus ulcers. Such ulcers cause discomforture in persons 12 who are sitting for prolonged periods of time.

Fluid cushion 10 is adapted to be placed on base surface 14 which may be a portion of chair 16 or other base surface, not important to the inventive concept as herein described. Application of fluid cushion 10 to chain 16 is shown in FIG. 1 with the user's body being shown in phantom line drawing. Fluid cushion 10 may be formed of a closed cell type of plastic composition such as polypropylene and further should be resilient to allow deformation as user 12 applies pressure to an external surface of fluid cushion 10. The particular composition of fluid cushion 10 is not important to the overall concept of the invention as herein described, with the exception that it must be fluid tight in order to maintain fluid 20 therein with a resiliency to allow applied load deformation. Obviously, the particular thickness of the walls of fluid cushion 10 must be sufficient to maintain structural integrity throughout applied load use.

Fluid cushion 10 includes fluid tight closed housing 22 which is formed of upper surface member 24 and lower surface member 26 shown in FIGS. 3 and 4. Upper surface member 24 and lower surface member 26 define peripheral edge 28 passing around the perimeter of fluid cushion 10 as shown in FIGS. 1 and 2. Upper and lower surface members 24 and 26 may be heat sealed at heat sealing section 30 shown in FIGS. 3 and 4 adjacent peripheral edge 28. In this manner, housing 22 is formed into a closed contour, resilient and deformable housing for application of forces applied by user 12.

As can be seen in FIGS. 1-4, each of upper and lower surface members 24 and 26 include a pair of upper surface member openings 32 and 34, as well as a pair of lower surface member openings 32' and 34', as is seen in FIG. 3. As can be seen in FIG. 4, the pair of lower surface member openings 32' and 34' are maintained in contiguous contact with base surface 14 whereas openings 32 and 34 of upper surface member 24 contiguously interface with the body of user 12.

In an undeformed state, as is apparent in FIGS. 2 and 3, upper surface member opening 32 is vertically aligned in vertical direction 36 with lower surface member opening 32' and similarly upper surface member opening 34 is vertically aligned with lower surface member opening 34'. In trying to relieve pressure on the ischium, it was found important that distance 38 between openings 32, 34 and 32', 34' be provided with a particular dimensional size. The bones under consideration are inclined in longitudinal direction 40 and the bone interface is narrow. Additionally, for different sized persons 12, distance 38 may be of differing value, however, it has been found that in order to obtain a placement for an average person 12, distance 38 should be in the range of approximately 4"-6". In this manner, there is placement in the transverse direction of the ischia spine bones which allows for substantial insert into or in the neighborhood of openings 32 and 34 formed through upper surface member 24. Additionally, due to the narrow bones under consideration and their longitudinal inclination, openings 32, 34 and 32' and 34' are of particular dimension in the approximate range of 1"-2". The concept is to allow the inclined longitudinally extending bones to be inserted at least partially within openings 32 and 34 during the applied force loading. Particularly, openings 32, 34 and 32', 34' are preferably formed in an oval shape to allow greater surface area contact by the bones in the depression formed during a deformation of fluid cushion 10. This obviously allows a greater surface area of the inclined longitudinally directed bone to impinge over a wider area during deformation and thus provides for a lower force on the bones of concern. For ease of construction, openings 32, 34 and 32', 34' may be formed in a circular contour which has also shown good results.

Figure 5:
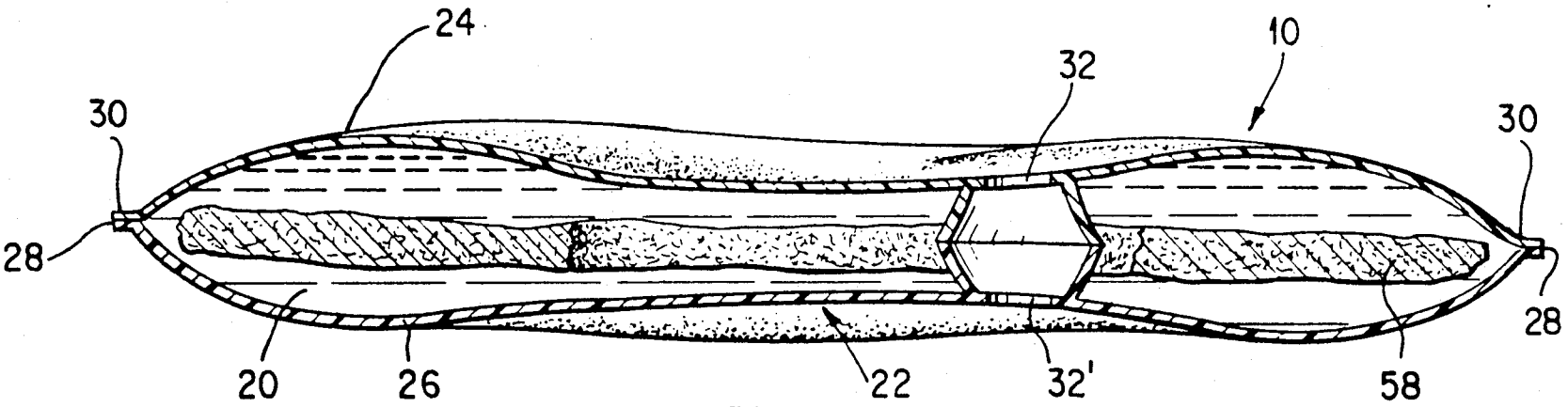

As is shown in FIGS. 3-5, there is further provided tubular mechanism 42 for joining upper and lower surface members 24 and 26 in fluid tight relation. Additionally, such tubular mechanisms 42 may be placed elsewhere, such as in the rear center to relieve pressure under the coccyx or base of the spine as previously described. Tubular mechanism 42 may be formed in one piece formation with upper and lower surface members 24 and 26 in fluid tight relation to provide vertically directed through passages 44 and 46, as shown in FIG. 3. Tubular mechanisms 42 have a particular contour as is shown in FIGS. 3-5. The particular contour is of extreme importance in operation of fluid cushion 10.

During the development of fluid cushion 10, the dimensional constraints of openings 32, 32' and 34, 34' were of importance due to the average body construction of person 12. Dimensional constraints for the distance between openings 38 were somewhat constricted to a rather low value and the dimensional size of openings 32, 34 and 32', 34' were also of a restricted size. The relative close proximity of openings 32, 34 each to the other in combination with the relatively small diameter of openings 32 and 34 provided a condition not foreseen at the beginning of the development. Due to the relatively small distance 38, when person 12 would apply pressure to upper surface member 24 of fluid cushion 10, base 48 between openings 32 and 34 would be substantially completely compressed into contiguous contact with base surface 14. This had the effect of not diminishing the discomforture level of user 12. At this stage of the development, tubular mechanism 42 was merely a tubular member of constant diameter.

It was found that providing a tubular mechanism 42 with a pair of sidewall members 50 of varying cross-sectional diameter when taken with respect to vertical direction 36, that space 48 was not diminished to the extent previously known. In particular, when tubular mechanism 44 by its sidewall members 50 was given a greater length than the vertical distance between openings 32 and 32' or 34 and 34' when fluid cushion 10 is in the undeformed state, upon compression there is a bulge formed providing apex 52 of sidewall members 50. The formation of sidewall members 50 in this type of configuration of a truncated cone as shown in FIGS. 3, 4 and 5, allows for space 48 between respective openings to maintain a sufficient amount of liquid or fluid 20 within the space upon deformation to maintain a cushioning effect on the body of user 12.

In overall concept, tubular mechanism 42 takes the form of a flexible grommet member which couples and reinforces the structural integrity of fluid cushion 10 through securement to upper and lower surface members 24 and 26. The exact theoretical mechanism of the sidewall members 50 of tubular mechanism 42 having a diameter of apex 52 greater than the diameter of openings 32 and 34 is not completely understood when taken in relation to the result of maintaining fluid within space 48 between the pair of tubular mechanisms 42. However, the provision of this type of bulging contour may aid in the maintenance of fluid 20 within space 48 by providing a greater surface area of sidewalls 42 in contact with fluid in space 48 thus diminishing the pressure within space 48 and the maintenance of fluid therein when fluid cushion 10 is deformed as is shown in FIG. 4.

In this manner, an internal chamber is provided containing fluid 20 wherein fluid is maintained in all sections of fluid cushion 10, even when load is applied through the body of user 12. The concept of the maintenance of fluid within space 48 is an important result found from the fact of the particular contouring of tubular mechanism 42 and specifically sidewall members 50. Thus, tubular sidewall members 50 define a diameter of apex 52 having a greater dimension than a diameter of upper and lower surface member openings 32, 34 and 32', 34' at a predetermined vertical position between upper and lower surface members 24 and 26 to achieve the necessary results.

In the preferred embodiment, it has been found that excellent results have occurred when the diameter of apex 52 is located substantially vertically mid-point of the vertical length of tubular sidewall members 50. Additionally, the tubular sidewall diameter in cross-section when taken with respect to vertical direction 36 varies substantially linearly and provides a truncated cone effect as is viewed for the cross-section shown in FIG. 3.

As shown in FIG. 3, fluid cushion 10 may include check valve member 54 of standard construction to allow insert of fluid 20 and maintenance within the internal chamber created by the fluid cushion 10. Valve cap 56 may be threadedly secured to check valve 54 to maintain a fluid tight relation.

Referring now to FIG. 5, there is shown a further embodiment of the subject invention including damping mechanism 58 for damping fluid waves produced by fluid medium 20 when force is applied to an external surface of fluid tight closed housing 22. Damping mechanism 58 may be a sponge-like material which absorbs a portion of the fluid medium 20 and may further be an open cell type construction. Additionally, damping mechanism 58 may be a resilient pad formed of an open wall plastic composition, or in the alternative may be a fibrous type of composition, such as nylon, to provide for a damping action when a dynamic load is imparted to fluid cushion 10 by user 12.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A fluid cushion including at least two spaced apart openings adapted to interface with the ischial spines of a sitting user of the cushion, said cushion comprising:

a fluid tight closed housing having an upper surface member and a lower surface member, each of said upper and lower surface members having at least two openings formed therethrough, said openings formed through said upper surface member being substantially vertically aligned with said openings formed through said lower surface member; and, tubular means for joining said upper and lower surface member openings in fluid tight relation defining a pair of vertically directed through passages having tubular sidewall members of varying cross-sectional diameters when taken with respect to a vertical direction, said housing and said tubular means defining an internal chamber containing a fluid medium wherein the tubular sidewall members define an apex diameter having a greater dimension than a diameter of said upper and lower surface member openings at a predetermined vertical position between said upper and lower surface members.

2. The fluid cushion as recited in claim 1 where said tubular sidewall members apex diameter is located substantially vertically midpoint of a vertical length of said tubular sidewall members.

3. The fluid cushion as recited in claim 2 where said tubular sidewall diameter varies substantially linearly when taken with respect to said vertical direction.

4. The fluid cushion as recited in claim 1 where said fluid cushion includes means for damping waves produced by said fluid medium when a force is applied to an external surface of said fluid tight closed housing.

5. The fluid cushion as recited in claim 4 where said means for damping waves includes a resilient member located within said internal chamber.

6. The fluid cushion as recited in claim 5 where said resilient member is formed of an open cell plastic composition.

7. The fluid cushion as recited in claim 5 where said resilient member is formed of a fibrous material.

8. The fluid cushion as recited in claim 5 where said resilient material is absorptive of a portion of said fluid medium.

9. The fluid cushion as recited in claim 1 where said fluid tight housing is formed of a closed cell plastic composition.

10. The fluid cushion as recited in claim 1 where each of said upper and lower surface members include a peripheral edge heat sealed each to the other in mating relation.

11. The fluid cushion as recited in claim 1 where said fluid medium is water.

12. The fluid cushion as recited in claim 1 where said fluid medium is air.

13. The fluid cushion as recited in claim 1 where said upper and lower surface member openings define a pair of vertically directed axes displaced each from the other by approximately 4.0 inches.

14. The fluid cushion as recited in claim 13 where said surface member openings define a major diameter approximating 1.0 inches.

15. A fluid cushion including at least two spaced apart openings adapted to interface with the ischial spines of a sitting user of the cushion, said cushion comprising:

a flexible fluid impervious housing defining a fluid chamber, said housing having a pair of openings formed through an upper and lower surface respectively, said openings being displaced from each other by a predetermined distance; and, a pair of flexible fluid imprevious grommets secured to said housing upper and lower surfaces around a periphery of said surface openings defining a pair of through passages directed vertically through said flexible impervious housing, wherein each of said fluid imprevious grommets includes a tubular sidewall having a diameter at substantially a vertical mid-point of said grommet which is greater than a diameter of said grommet on vertically opposing ends thereof.

16. The fluid cushion as recited in claim 15 where said fluid cushion includes means for damping waves of a fluid medium contained within said flexible fluid imprevious housing.

17. The fluid cushion as recited in claim 15 where said openings are displaced each from the other by approximately four inches.

* * * * *